US006789880B2

(12) United States Patent
Chou et al.

(10) Patent No.: US 6,789,880 B2
(45) Date of Patent: Sep. 14, 2004

(54) MICROINJECTOR FOR JETTING DROPLETS OF DIFFERENT SIZES

(75) Inventors: Chung-Cheng Chou, Taipei (TW); Tsung-Ping Hsu, Tao-Yuan Hsien (TW); In-Yao Lee, Taipei Hsien (TW); Wei-Lin Chen, Taipei (TW); Hung-Sheng Hu, Kao-Hsiung (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 10/064,254

(22) Filed: Jun. 26, 2002

(65) Prior Publication Data

US 2003/0001924 A1 Jan. 2, 2003

(30) Foreign Application Priority Data

Jun. 28, 2001 (TW) ..... 90115841 A

(51) Int. Cl.[7] ..... B41J 2/14; B41J 2/16; B41J 2/05; B41J 2/17; B41J 2/015

(52) U.S. Cl. ..... 347/48; 347/65; 347/94; 347/20; 347/53; 347/56; 347/63; 347/84

(58) Field of Search ..... 347/48, 65, 94

(56) References Cited

U.S. PATENT DOCUMENTS 4,928,125 A * 5/1990 Iino ..... 347/54
5,886,716 A 3/1999 Heinzl et al.
6,244,690 B1 * 6/2001 Kwon et al. ..... 347/54
6,331,043 B1 * 12/2001 Shimazu et al. ..... 347/48
6,439,691 B1 * 8/2002 Lee et al. ..... 347/48
6,460,961 B2 * 10/2002 Lee et al. ..... 347/15
6,474,769 B1 * 11/2002 Imanaka et al. ..... 347/19
6,530,648 B2 * 3/2003 Leu et al. ..... 347/48
6,536,877 B2 * 3/2003 Miyamoto et al. ..... 347/58
6,595,627 B2 * 7/2003 Min et al. ..... 347/65
6,705,716 B2 * 3/2004 Mott ..... 347/94
2002/0008734 A1 * 1/2002 Lee et al. ..... 347/48
2003/0137559 A1 * 7/2003 Chen et al. ..... 347/48

FOREIGN PATENT DOCUMENTS

DE 44 28 807 A1 2/1996
EP 0 317 171 A2 5/1989
EP 1 149 705 A1 10/2001
WO WO 9937486 A1 * 7/1999 ..... B41J/2/05

* cited by examiner

*Primary Examiner*—Stephen D. Meier
*Assistant Examiner*—Leonard Liang
(74) *Attorney, Agent, or Firm*—Winston Hsu

(57) ABSTRACT

A microinjector uses bubbles as virtual valves to eject droplets of different sizes. The microinjector is in fluid communications with a reservoir and has a substrate, an orifice layer, and a plurality of nozzles. The substrate has a manifold for receiving ink from the reservoir. The orifice layer is positioned on the top of the substrate so that a plurality of chambers are formed between the orifice layer and the top of the substrate. Each of the nozzles has an orifice and at least three bubble generating components. The bubble generating components are selectively driven by a driving circuit so that each nozzle can eject droplets of different sizes.

29 Claims, 20 Drawing Sheets

MICROINJECTOR FOR JETTING DROPLETS OF DIFFERENT SIZES

BACKGROUND OF INVENTION

1. Field of the Invention

The present invention relates to a jet, and more particularly, to a jet that can eject droplets of different sizes.

2. Description of Related Art

Currently, jets spraying droplets of different sizes are widely used to improve the combustion efficiency of fuel in engines, or to increase the selectivity of ink jet printing. For example, when ink jet printers can print documents by way of ink droplets that have differing sizes, they are better able to improve both color variability and printing speed.

Please refer to FIG. 1, which is a side view of a jet 10 according to a related art. The jet 10 is disclosed in U.S. Pat. No. 4,251,824; "Liquid jet recording method with variable thermal viscosity modulation". The jet 10 uses a plurality of heat generating bodies disposed on an axis of a liquid chamber 12 to provide energy individually or in turn, and in doing so generates a plurality of foam formations 31~35 in different positions of the chamber 12 to eject droplets of different sizes for printing. Although the jet 10 can eject droplets of different sizes, there is an undesired characteristic in that the jet 10 also readily ejects satellite droplets. When the foam formations 31~35 force out droplets 40, a tail of a droplet 40 may become separated from its associated body, forming another droplet in the period of expansion and contraction of the foam formations 31~35. These separated droplets are called satellite droplets. The generation of such satellite drops causes printed documents to take on a fuzzy appearance, or a lessening of contrast. The satellite droplets generated by the jet 10 follow after the main droplets. When the jet 10 has a relative motion to a printed document, the satellite droplets are printed onto the document in positions to differ from those of their parent main droplets. Thus, the printing capability of the jet 10 is adversely affected by the satellite droplets.

U.S. Pat. Nos. 6,102,530 and 6,273,553 "Apparatus and method for using bubble as virtual valve in microinjector to eject fluid" disclosed an apparatus and method for forming a bubble within a microchannel of a microinjector to function as a valve mechanism between the chamber and manifold. These patents have been assigned to Acer Communications & Multimedia, presently known as BenQ Corporation, which is also the assignee of the present application.

SUMMARY OF INVENTION

It is therefore a primary objective of the present invention to provide a jet which can eject droplets of different sizes without satellite droplets to solve the above-mentioned problem.

In a preferred embodiment, the present invention provides a jet which uses a bubble as a virtual valve to increase the resistance between a chamber and a manifold, or to interrupt flow communications between the chamber and the manifold. Another bubble is then used to squeeze fluid from the chamber. The jet is in flow communications with a reservoir, and comprises a substrate, an orifice layer and a plurality of nozzles. The substrate comprises a manifold, which is used to receive fluid from the reservoir. The orifice layer is disposed above the substrate so that a plurality of chambers are formed between the orifice layer and the substrate. Each of the nozzles comprises an orifice and at least three bubble generators. In the present invention, different bubble generators are driven selectively to generate two bubbles, leading to a plurality nozzles that jet droplets of different sizes from the orifice thereon.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
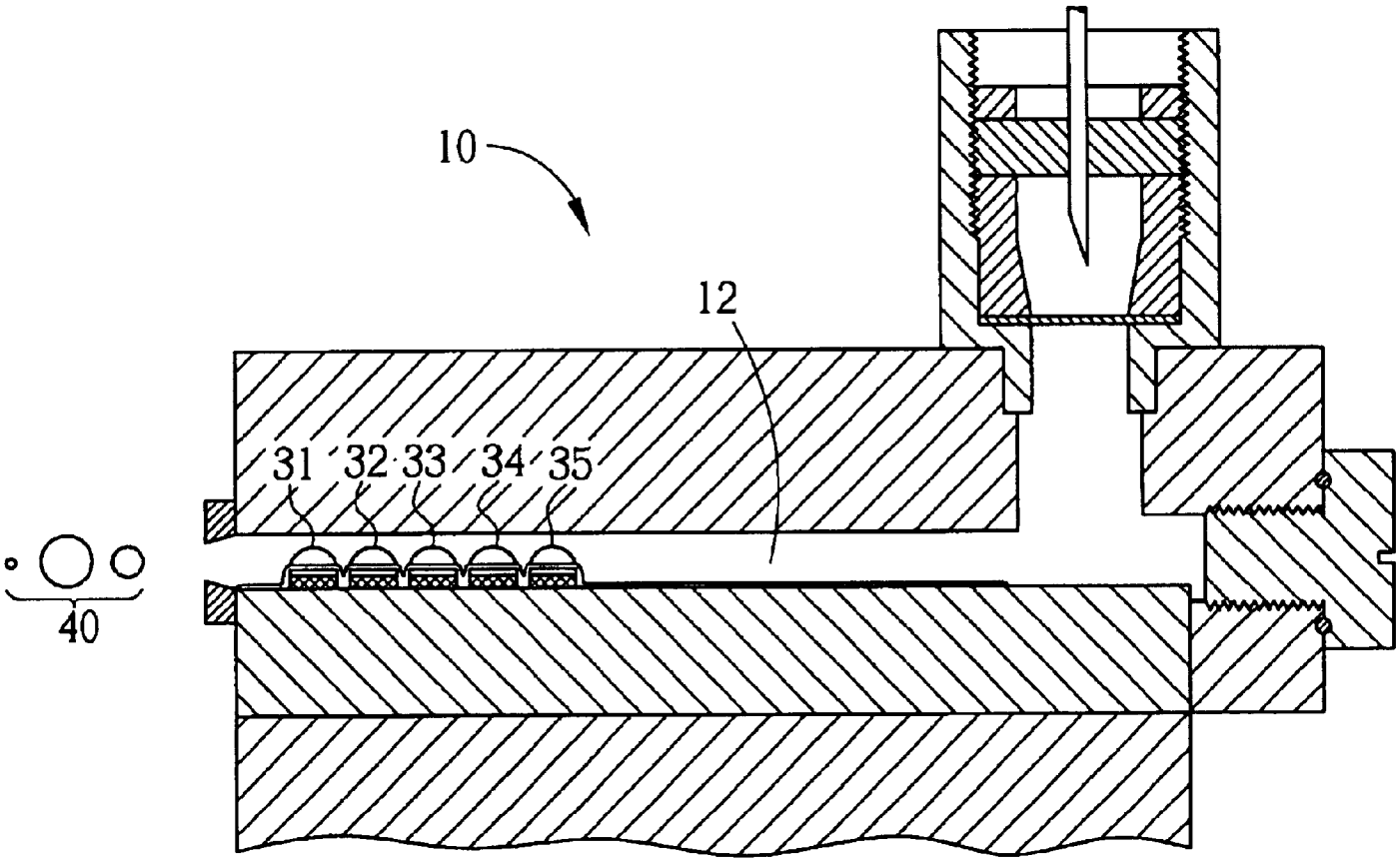
Fig. 1 Prior art
FIG. 1 is a side view of a jet according to the prior art.
Figure 2:
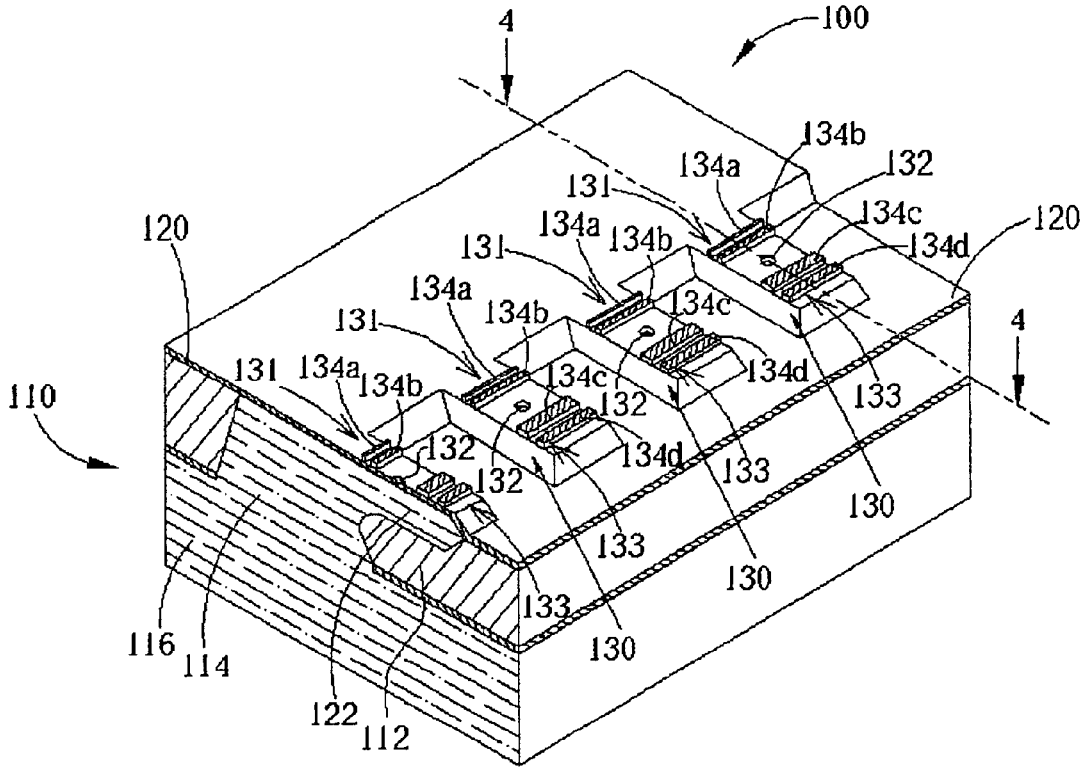
FIG. 2 is a schematic diagram of a jet according to the present invention.

Please refer to FIG. 2, which is a schematic diagram of a jet 100 according to one embodiment of the present invention. The jet 100 is in flow communications with a reservoir 110 and comprises a substrate 112 positioned above the reservoir 110 and an orifice layer 120 positioned on the substrate 112 so that a plurality of chambers 122 are formed between the orifice layer 120 and the substrate 112. The substrate 112 comprises a manifold 114 for transporting fluid from the reservoir 110 to the jet 100. A plurality of nozzles 130 are disposed on the orifice layer 120, and each nozzle 130 corresponds to one chamber 122. In the present embodiment, each nozzle 130 comprises an orifice 132 and four parallel bubble generators 134*a*, 134*b*, 134*c* and 134*d*. The bubble generators 134*a* and 134*b* are disposed on a first side 131 of the orifice 132, and the bubble generators 134*c* and 134*d* are disposed on a second side 133 of the orifice 132. In addition, the bubble generators 134*a*, 134*b*, 134*c* and 134*d* are electrically connected to a driving circuit (not shown), which drives the bubble generators 134*a*, 134*b*, 134*c* and 134*d* to generate bubbles in their corresponding chamber 122. The orifice 132 is formed on the orifice layer 120, and is positioned to correspond to the chamber 122. In the present embodiment, each of the bubble generators 134*a*, 134*b*, 134*c* and 134*d* is a heater that heats a fluid 116 inside the chamber 122 to generate bubbles. In a preferred embodiment of the present invention, the orifice layer 120 is composed of a low stress material with a residual stress lower than 300 MPa, such as a silicon rich nitride, to avoid the orifice layer 120 from being broken by the high residual stress incurred from fabricating the jet 100.

Figure 3:
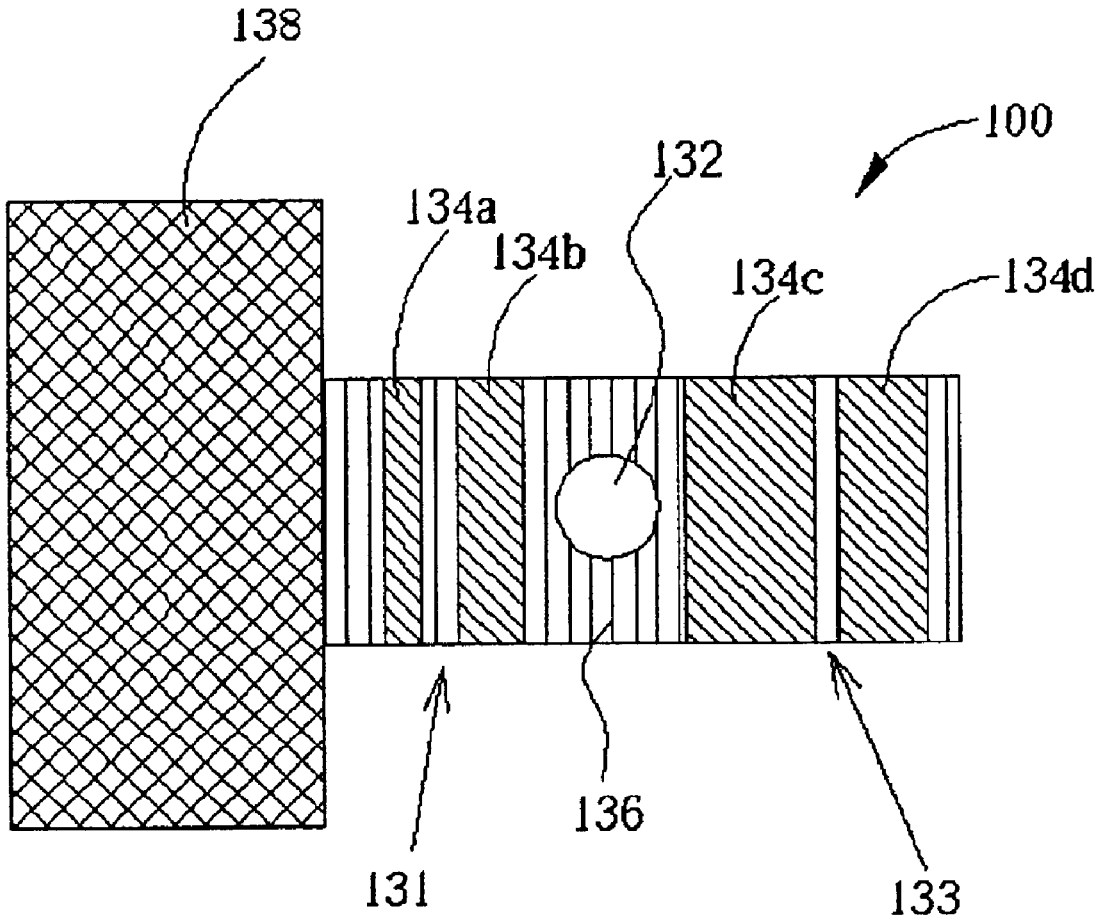
FIG. 3 is a top view of a nozzle shown in FIG. 2.
Figure 4:
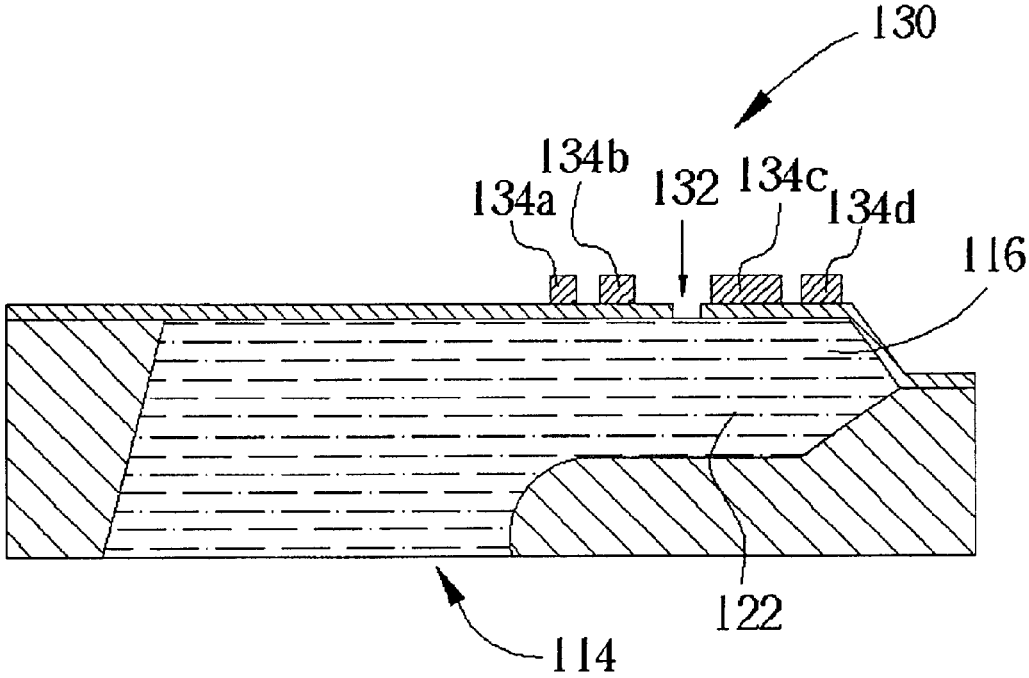
FIG. 4 is a section view along line 4—4 of the jet shown in FIG. 2.
Figure 5:
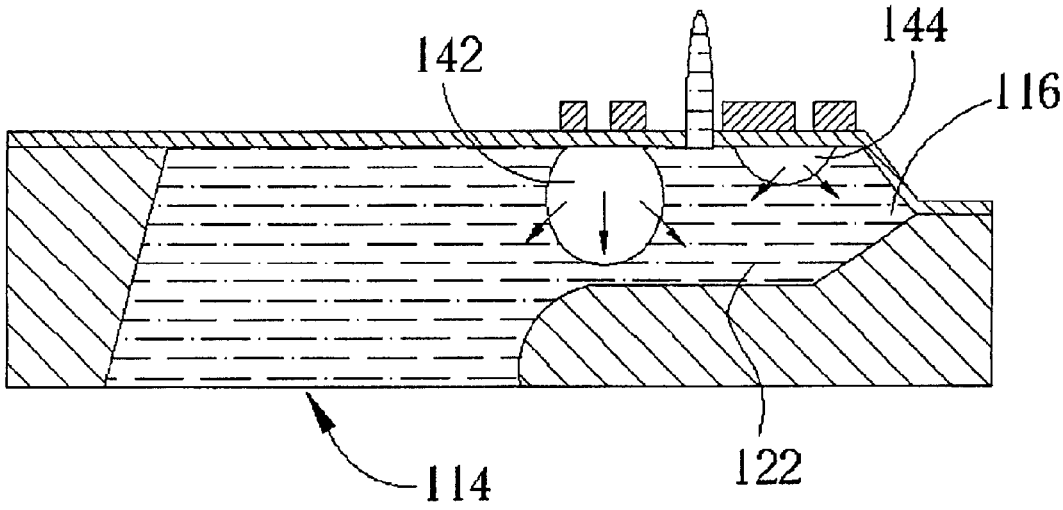
FIG. 5 is a cross-sectional diagram of the jet shown in FIG. 2 when a bubble is generated.
Figure 6:
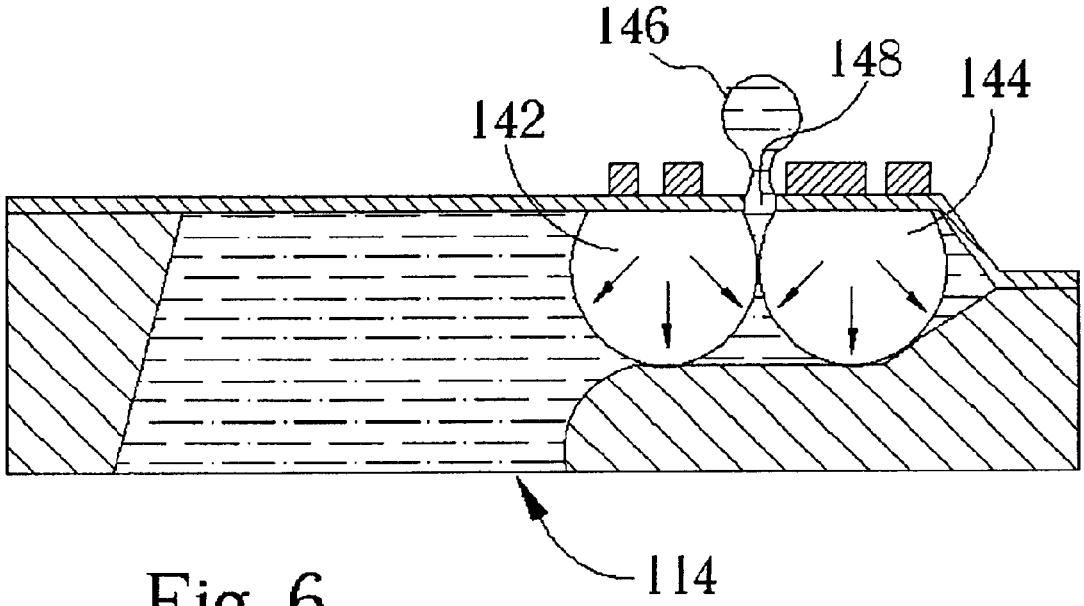
FIG. 6 is a cross-sectional diagram of the jet shown in FIG. 2 when a droplet is ejected.

Please refer to FIG. 3 to FIG. 6. FIG. 3 is a top view of one of the nozzles 130 shown in FIG. 2. FIG. 4 is a sectional view along line 4—4 of the jet 100 shown in FIG. 2. FIG. 5 is a cross-sectional diagram of the jet 100 shown in FIG. 2 when a bubble is generated. FIG. 6 is a cross-sectional diagram of the jet 100 shown in FIG. 2 when a droplet is ejected. A first region 136 and a second region 139 are shown in FIG. 3. There is a corresponding chamber 122 under the first region 136, and a manifold 114 under the second region 138. Heaters 134*a*, 134*b*, 134*c* and 134*d* are disposed on the first side 131 and the second side 133, wherein the first side 131 is closer to the manifold 114 than the second side 133 is to the manifold 114. As a result, the heaters 134*a* and 134*b* positioned on the first side 131 are closer to the manifold 114 than the heaters 134*c* and 134*d* positioned on the second side 133. As shown in FIG. 4 to FIG. 6, the driving circuit (not shown) drives the heaters 134*a* and 134*b* disposed on the first side 131 to heat the fluid 116 inside the chamber 122 to generate a first bubble 142 and a second bubble 144 in turn. When the first bubble 142 is generated, the first bubble 142 prevents the fluid 116 inside the chamber 122 from flowing into the manifold 114, and hence a virtual valve is formed that isolates the chamber 122 from the manifold 114. As a result, cross-talk between adjacent chambers 122 is prevented. After the first bubble 142 is generated, the heaters 134*c* and 134*d* are driven by the driving circuit to generate a second bubble 144. As the second bubble expands, the pressure of the fluid 116 inside the chamber 122 increases until a droplet 146 is ejected. As the first bubble 142 and the second bubble 144 continue to expand, they approach each other as shown in FIG. 6. When the two bubbles combine, they stop forcing the fluid 116. Momentum carries the completed droplet 146 from the orifice 132. The tail 148 of the droplet 146 is cut suddenly so that no satellite droplet is generated.

The driving circuit can drive the heaters 134*a*, 134*b*, 134*c* and 134*d* selectively to heat the fluid 116 inside the chamber 122 so that droplets of different sizes are ejected from the orifice 132. More specifically, when the driving circuit drives the heaters 134*a* and 134*b* positioned on the first side, the driving circuit may drive the heater 134*a* or 134*b* to heat fluid 116. Controlling the amount of heat supplied by the heater 134*a* and 134*b* to the fluid 116 causes first bubbles 142 of different sizes to be generated. In the same manner, the driving circuit can also control the heaters 134*c* and 134*d* to provide different amounts of heat to the fluid 116 so that second bubbles 144 of different sizes are generated. Since an interval between the heater 134*a* and the orifice 132 is larger than an interval between the heater 134*b* and the orifice 132, and similarly an interval between the heater 134*d* and the orifice 132 is larger than an interval between the heater 134*c* and the orifice 132, so the amount of residual fluid 116 between two bubbles 142 and 144 is different if different heaters 134*a*, 134*b*, 134*c* and 134*d* are driven. Even with the same amount of energy being provided to the heater 134*a* and the heater 134*b*, droplets of different sizes are generated when driving the heaters 134*a* and 134*c* as versus the heaters 134*b* and 134*c*, because between heaters 134*a* and 134*c* there is more residual fluid 116 than between heaters 134*b* and 134*c*. Thus, by driving the heaters 134*a*, 134*b*, 134*c* or 134*d* selectively, bubbles of different sizes are generated to eject different amounts of fluid 116 so that droplets of different sizes are ejected from the orifice 132 of the nozzle 130.

Figure 7:
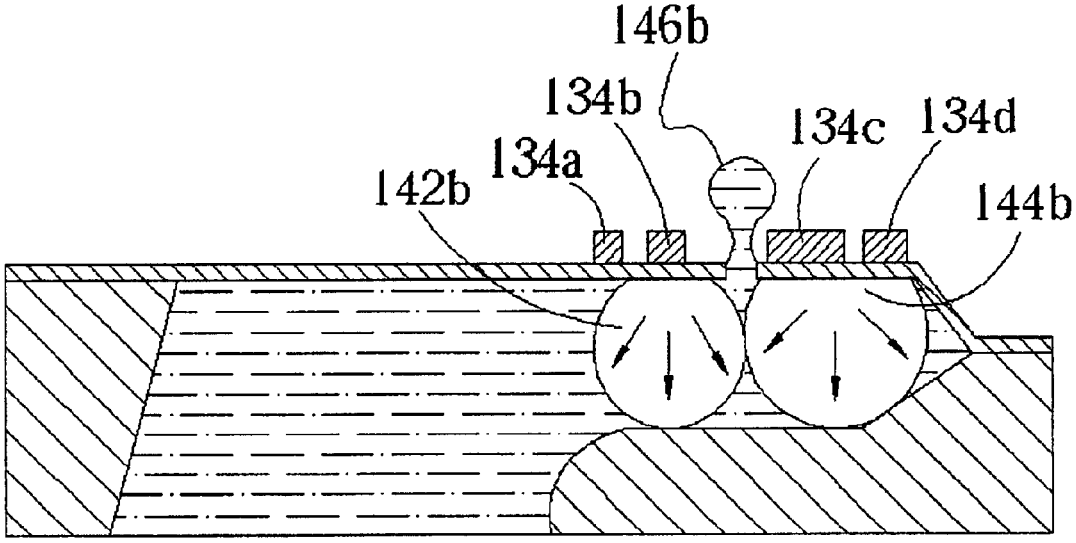
FIG. 7 is a second cross-sectional diagram of the jet shown in FIG. 2 when a droplet is ejected.
Figure 8:
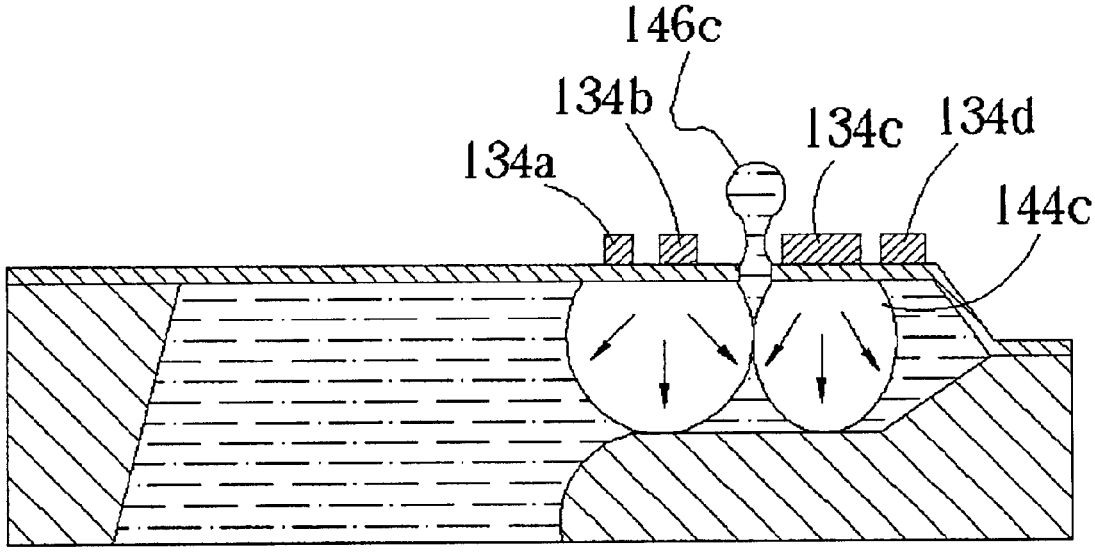
FIG. 8 is a third cross-sectional diagram of the jet shown in FIG. 2 when a droplet is ejected.

Please refer to FIG. 7 and FIG. 8. FIG. 7 is a second cross-sectional diagram of the jet 100 shown in FIG. 2 when a droplet is ejected. FIG. 8 is a third cross-sectional diagram of the jet 100 shown in FIG. 2 when a droplet is ejected. Please refer to FIG. 7 with reference to FIG. 6. A first bubble 142*b* generated by the heater 134*b* is smaller than the first bubble 142 generated by the heaters 134*a* and 134*b*. Thus, when the heater 134*c* and 134*d* heats the fluid 116 to generated a second bubble 144*b*, the residual fluid 116 between the first bubble 142*b* and the second bubble 144*b* is less than that between the first bubble 142 and the second bubble 144, and so a droplet 146*b* ejected from the orifice 132 is smaller than the droplet 146. Please refer to FIG. 8 with reference to FIG. 6. A second bubble 144*c* is generated by the heater 134*c* so that a droplet 146*c* ejected from the orifice 132 is smaller than the droplet 146. It should be emphasized that driving circuit is not restricted to driving the heaters 134*a*, 134*b*, 134*c* and 134*d* to the three methods mentioned above. Other methods are also possible, such as generating a first bubble by both the heaters 134*a* and 134*b*, or by only one of the heaters 134*a* and 134*b*. Similarly, the second bubble may be generated by both the heaters 134*c* and 134*d*, or by only one of the heaters 134*c* and 134*d*. The present invention may utilize different methods of driving the heaters 134*a*, 134*b*, 134*c* and 134*d* selectively to change the thermal energy supplied to the fluid 116 so that the first bubbles and the second bubbles of different sizes are generated, and hence droplets of different sizes are ejected.

Figure 9:
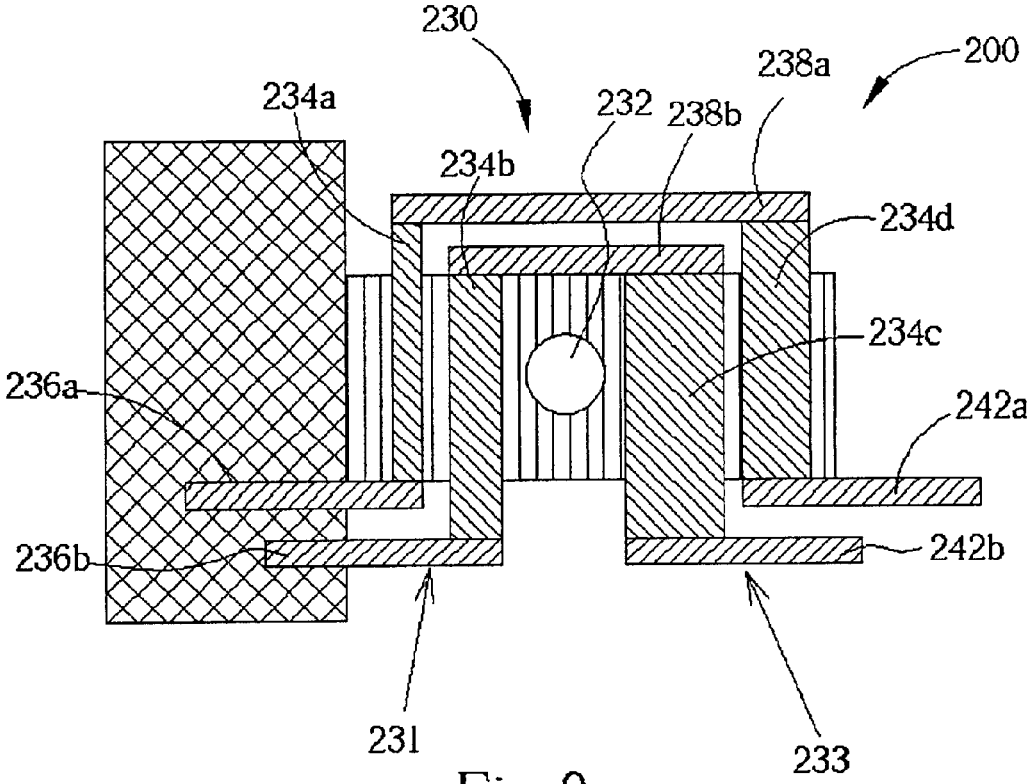
FIG. 9 is a top view of a nozzle of a jet according to a second embodiment of the present invention.

Please refer to FIG. 9. FIG. 9 is a top view of a jet 200 according to a second embodiment of the present invention. Each nozzle 230 of the jet 200 comprises an orifice 232 and four bubble generators 234*a*, 234*b*, 234*c* and 234*d*, wherein the four bubble generators are all heaters disposed on a first side 231 and a second side 233 of the orifice 232. The heater 234*a* is electrically connected to a signal wire 236*a* and connected to the heater 234*d* via a conducting wire 238*a* in series. In addition, the heater 234*d* is electrically connected to a grounded wire 242*a* and the heater 234*c* is electrically connected to a grounded wire 242*b*. Thus, the signal wire 236*a*, the heater 234*a*, the conducting wire 238*a*, the heater 234*d* and the grounded wire 242*a* are electrically connected in series so that a circuit is formed. The signal wire 236*b*, the heater 234*b*, the conducting wire 238*b*, the heater 234*c* and the grounded wire 242*b* are electrically connected in series and form another circuit. When the driving circuit drives the heaters 234*a*, 234*b*, 234*c* and 234*d* to generate a first bubble and a second bubble in their corresponding chambers, a voltage is applied to the signal wire 236*a* and signal wire 236*b*. After the voltage is applied to the signal wire 236*a*, the heater 234*a* and the heater 234*d* heat fluid inside the corresponding chambers respectively. In the same manner, after the voltage is applied to the signal wire 236*b,* the heaters 234*b* and 234*c* also heats fluid inside corresponding chambers, respectively. The cross-sectional area of the heater 234*a* is smaller than that of 234*d,* and so the resistance of the heater 234*a* is larger than that of the heater 234*d* under otherwise similar conditions such as length, thickness and material. As a result, when the driving circuit applies a voltage to the signal wire 236*a,* the heater 234*a* generates a first bubble earlier than the heater 234*d* generates a second bubble. In the same manner, since a cross-sectional area of the heater 234*b* is larger than that of the heater 234*c,* a resistance of the heater 234*b* is larger than that of the heater 234*c* with the same length, thickness and material. Thus, the heater 234*b* generates a first bubble earlier than the heater 234*c* generates a second bubble when the driving circuit applies a voltage to the signal wire 236*b.* Of course, the methods used for connecting heaters according to the present invention are not restricted to those mentioned above. The same effect can be achieved by parallel connections. For example, the heaters disposed on the first side 231, such as 234*a* or 234*b,* can be electrically connected in parallel to the heaters disposed on the second side 233, such as 234*c* or 234*d,* and both of the heaters connected in parallel are then electrically connected to a signal wire, such as 236*a* or 236*b,* and a grounded wire, such as 242*a* or 242*b.* Note that as the two heaters are connected in parallel, the resistance of the heater disposed on the first side 231 must be smaller than that of the heater disposed on the second side. As a result, when the driving circuit applies a voltage to the two paralleled heaters, the heater 231 disposed on the first side 231 generates a first bubble which functions as a virtual valve earlier than the heater disposed on the second side 233. In addition, the driving circuit can apply a voltage to the signal wire 236*a* and 236*b* simultaneously so that the heaters 234*a,* 234*b,* 234*c* and 234*d* heat fluid inside the corresponding chamber to generate a first bubble and a second bubble. The driving circuit can also apply a voltage to a single signal wire 236*a* or 236*b* so that only one series circuit, which may include the heaters 234*a* and 234*d* or the heaters 234*b* and 234*c,* heats fluid. Thus, the heaters 234*a,* 234*b,* 234*c* and 234*d* are driven selectively, and droplets of different sizes are ejected from the orifice 232.

Figure 10:
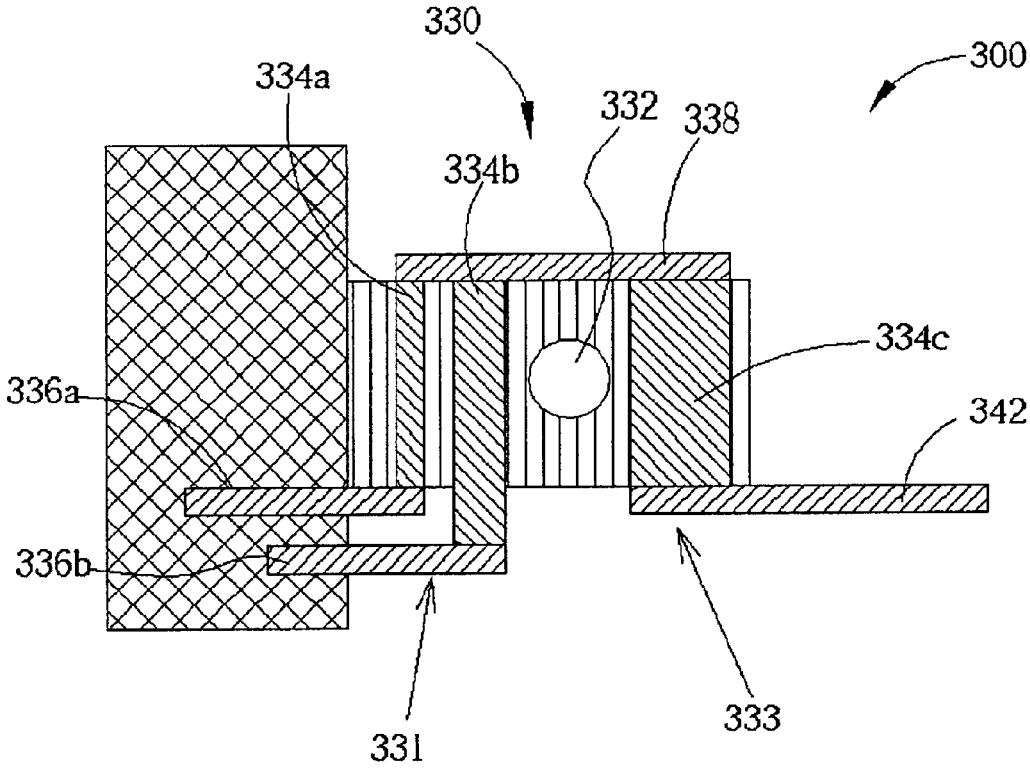
FIG. 10 is a top view of a nozzle of a jet according to a third embodiment of the present invention.

Please refer to FIG. 10, which is a top view of a nozzle 330 of a jet 300 according to a third embodiment of the present invention. Each nozzle 330 of the jet 300 comprises an orifice 332 and three bubble generators 334*a,* 334*b* and 334*c* which are electrically connected to a driving circuit (not shown). Each of the bubble generators is a heater, wherein the heaters 334*a* and 334*b* are disposed on a first side 331 of the orifice 332, and the heater 334*c* is disposed on a second side 333 of the orifice 332. As shown in FIG. 10, the heater 334*a* is electrically connected to a signal wire 336*a* and connected to the heater 334*c* in series via a conducting wire 338. The heater 334*c* is electrically connected to a grounded wire 342. Thus, the signal wire 336*a,* the heater 334*a,* the conducting wire 338, the heater 334*c* and the grounded wire 342 form a circuit. The signal wire 336*b,* the heater 334*b,* the conducting wire 338, the heater 334*c* and the grounded wire 342 form another circuit. When the driving circuit drives the heaters 334*a,* 334*b,* 334*c* to generate first bubbles and second bubbles in their corresponding chamber, a voltage is applied to the signal wire 336*a* and the 336*b.* In a preferred embodiment of the present invention, the driving circuit can apply voltages to the signal wire 336*a* and 336*b* simultaneously so that the heaters 334*a,* 334*b* and 334*c* heat fluid inside the corresponding chamber to generate first bubbles and second bubbles. The driving circuit can also apply a voltage to either the conducting wire 336*a* or the conducting wire 336*b* so that only one of the heaters 334*a* and 334*b* heats fluid to generate a first bubble. In the present embodiment, the driving circuit controls the amount of energy supplied to the heaters 334*a* and 334*b* on the first side 331 of the orifice 332 to change the sizes of bubbles. As a result, droplets of different sizes are ejected from the orifice 332.

Figure 11:
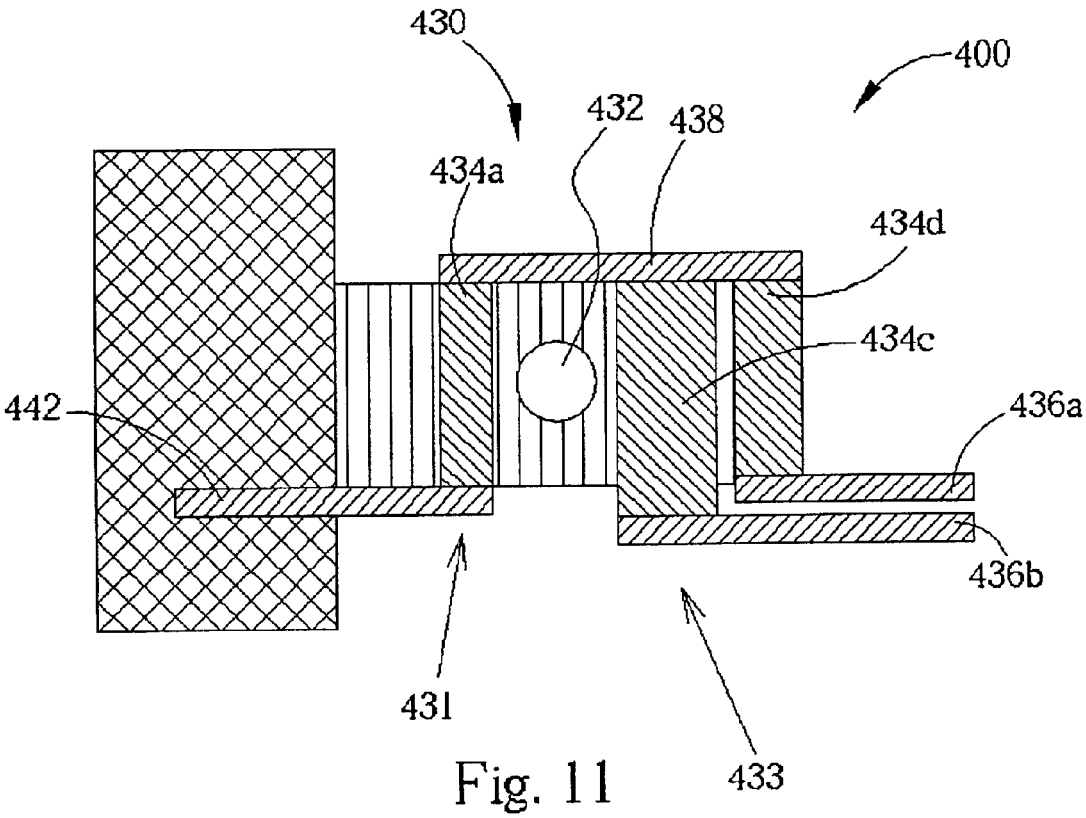
FIG. 11 is a top view of a nozzle of a jet according to a fourth embodiment of the present invention.

Please refer to FIG. 11, which is a top view of a nozzle 430 of a jet 400 according to a fourth embodiment of the present invention. Each nozzle 430 of the jet 400 comprises an orifice 432 and three heaters 434*a,* 434*c* and 434*d,* which are electrically connected to a driving circuit. The heater 434*a* is disposed on a first side 431 of the orifice 432 and the heaters 434*c* and 434*c* are disposed on a second side 433 of the orifice 432. As shown in FIG. 11, the heater 434*d* is electrically connected to a signal wire 436*a* and connected to the heater 434*a* via a conducting wire 438 in series. The heater 434*c* is electrically connected to a signal wire 436*b* and connected to the heater 436*a* via the conducting wire 438. The heater 434*a* is electrically connected to a grounded wire 442. Thus, the signal wire 436*a,* the heater 434*d,* the conducting wire 438, the heater 434*a* and the grounded wire 442 form a circuit. The signal wire 436*b,* the heater 434*c,* the conducting wire 438, the heater 434*a* and the grounded wire 442 form another circuit. As the driving circuit drives the heaters 434*a,* 434*c* and 434*d* to generate a first bubble and a second bubble in their corresponding chamber, a voltage is applied to the signal wire 436*a* and 436*b,* wherein the driving circuit can apply the voltage to the signal wire 436*a* and 436*b* so that the heaters 434*a,* 434*c* and 434*d* can heat fluid inside the corresponding chamber to generate first bubbles and second bubbles. The driving circuit can also apply a voltage to one signal wire 436*a* or 436*b* so that only one of the heaters 434*c* and 434*d* heats fluid to generate a second bubble. In the present embodiment, the driving circuit simultaneously controls the energy supplied to the heaters 434*c* and 434*d* disposed on the second side 433 of the orifice 432 to change the sizes of second bubbles so that droplets of different sizes are ejected from the orifice 432.

Figure 12:
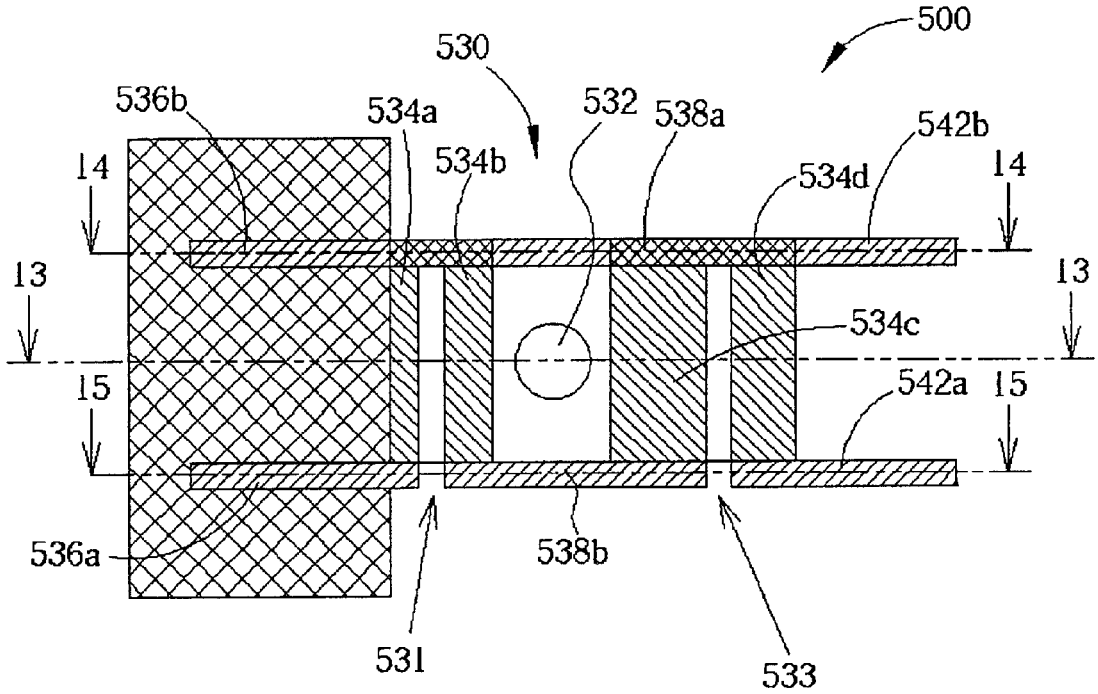
FIG. 12 is a top view of a nozzle of a jet according to a fifth embodiment of the present invention.
Figure 13:
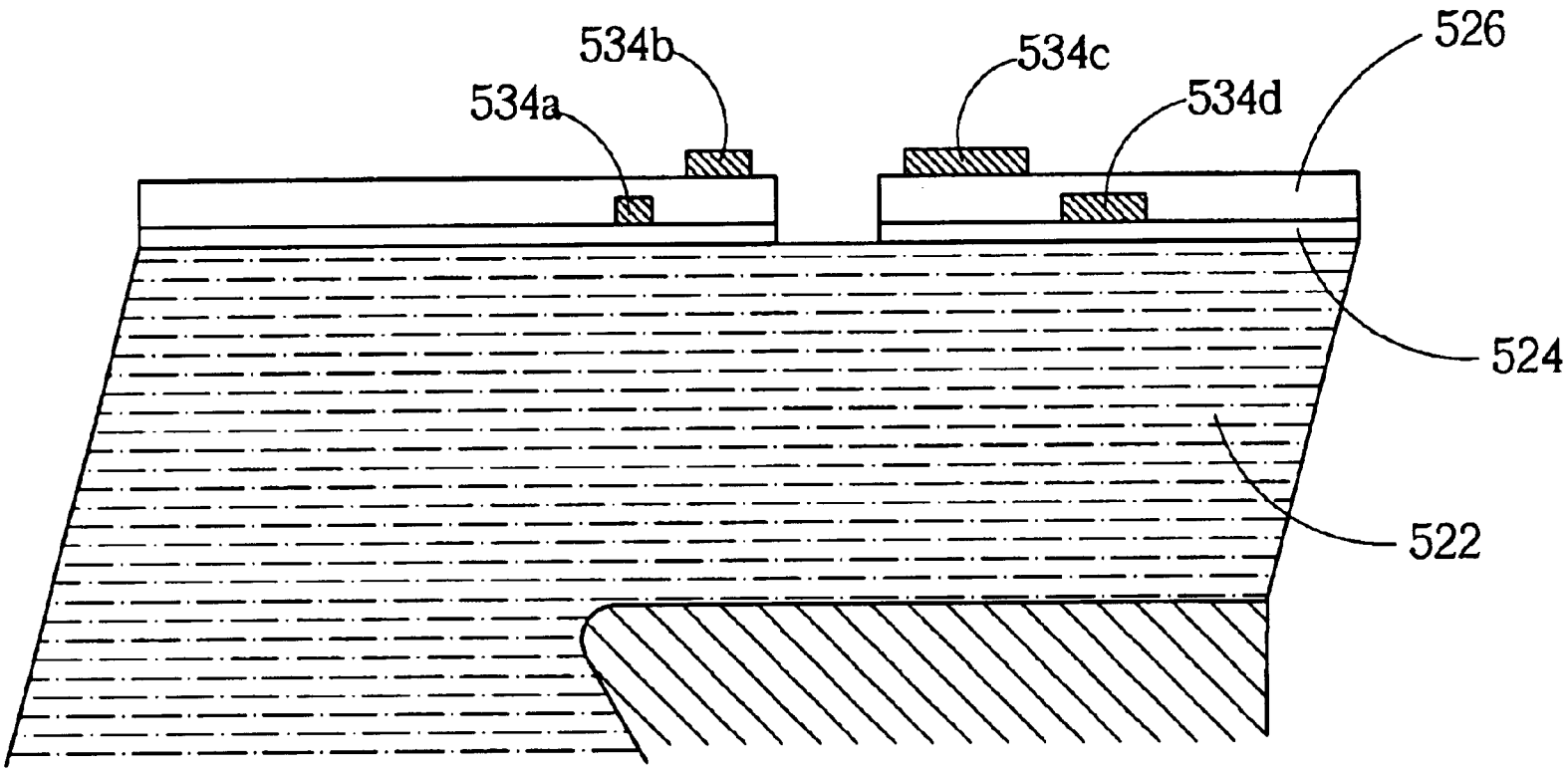
FIG. 13 is a section view along line 13—13 of the nozzle shown in FIG. 12.
Figure 14:
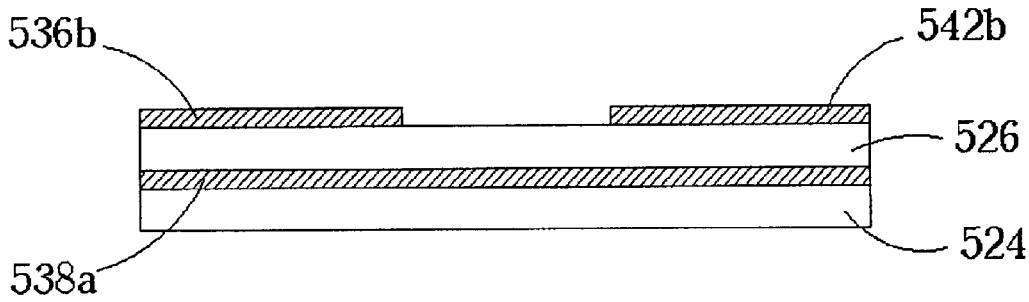
FIG. 14 is a section view along line 14—14 of the nozzle shown in FIG. 12.
Figure 15:
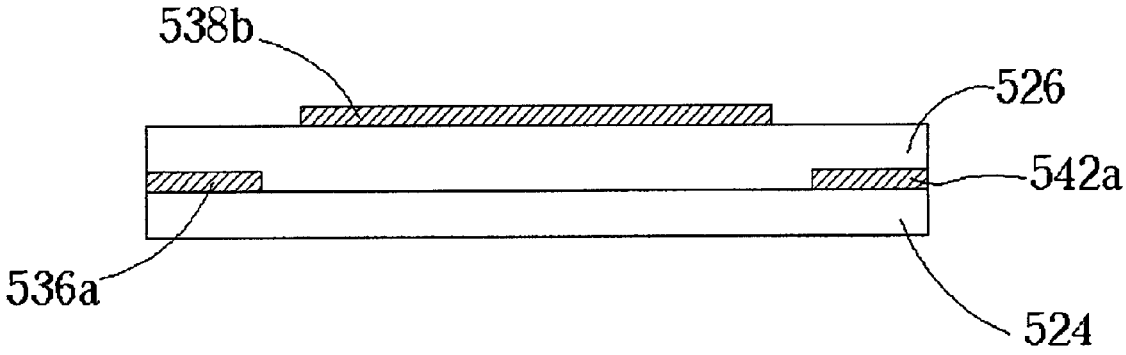
FIG. 15 is a section view along line 15—15 of the nozzle shown in FIG. 12.

Please refer FIG. 12 to FIG. 15. FIG. 12 is a top view of a nozzle 530 of a jet 500 according to a fifth embodiment of the present invention. FIG. 13 is a sectional view along line 13—13 of the nozzle 530. FIG. 14 is a sectional view along line 14—14 of the nozzle 530. FIG. 15 is a sectional view along line 15—15 of the nozzle 530. The jet 500 is similar to the jet 200. The major difference is that the jet 500 comprises two parallel structure layers, a first structure layer 524 and a second structure 526, and heaters disposed on the first structure layer 524 and the second structure layer 526. As shown in FIG. 12, each nozzle 530 of the jet 500 comprises an orifice 532 and four heaters 534*a,* 534*b,* 534*c* and 534*d.* The heaters 534*a* and 534*b* are disposed on the first side 531 of the orifice 532, and the 534*c* and 534*d* are disposed on the second side 533 of the orifice 532. The heaters 534*a* and 534*d* are disposed on the first structure layer 524, and the heaters 534*b* and 534*c* are disposed on the second structure layer 526. The heater 534*a* is electrically connected to a signal wire 536*a,* and connected to the heater 534*d* in series via a conducting wire 538*a.* The heater 534*b* is electrically connected to a signal wire 536*b,* and connected to the heater 534*c* in series via a conducting wire 538. In addition, the heater 534*d* is electrically connected to a grounded wire 542*a* and the heater 534*c* is electrically connected to a grounded wire 542*b.* Thus, the signal wire, the heater 534*a,* the conducting wire 538*a,* the heater 534*d* and the grounded wire 542*a* form a series circuit. The signal wire 536*b,* the heater 534*b,* the conducting wire 538*b,* the heater 534*c* and the grounded wire 542*b* form another series circuit. As described above, the heaters 534*a* and 534*b,* and the heaters 534*c* and 534*d,* are disposed on the first structure layer 524 and the second structure layer 526, respectively. In a comparison with the jet 200, the jet 500 forms the two series circuits within a smaller area so that the jet 500 comprises more nozzles 530 in the same unit of area. When the driving circuit drives the heaters 534*a,* 534*b,* 534*c* and 534*d* to generate first bubbles and second bubbles in corresponding chambers, a voltage is applied to the signal wire 536*a* and 536*b*. When the voltage is applied to the signal wire 536*a,* the heater 534*a* and 534*d* heat fluid inside corresponding chambers, respectively. In the same manner, when a voltage is applied to the signal wire 536*b,* the heaters 534*b* and 534*c* also heat fluid inside corresponding chambers, respectively. In addition, the driving circuit can apply a voltage to the signal wires 536*a* and 536*b* at the same time so that the heaters 534*a,* 534*b,* 534*c* and 534*d* heat fluid inside corresponding chambers 522 to generate first bubbles and second bubbles simultaneously. The driving circuit can apply a voltage to one of the signal wires 536*a* and 536*b,* in which case only one circuit operates. The driving circuit may drive the heaters 534*a* and 534*d,* or the heaters 534*b* and 534*c* disposed on the other circuit. As a result, the heaters 534*a,* 534*b,* 534*c* and 534*d* can be driven selectively so that droplets of different sizes are ejected from the orifice 532.

Figure 16:
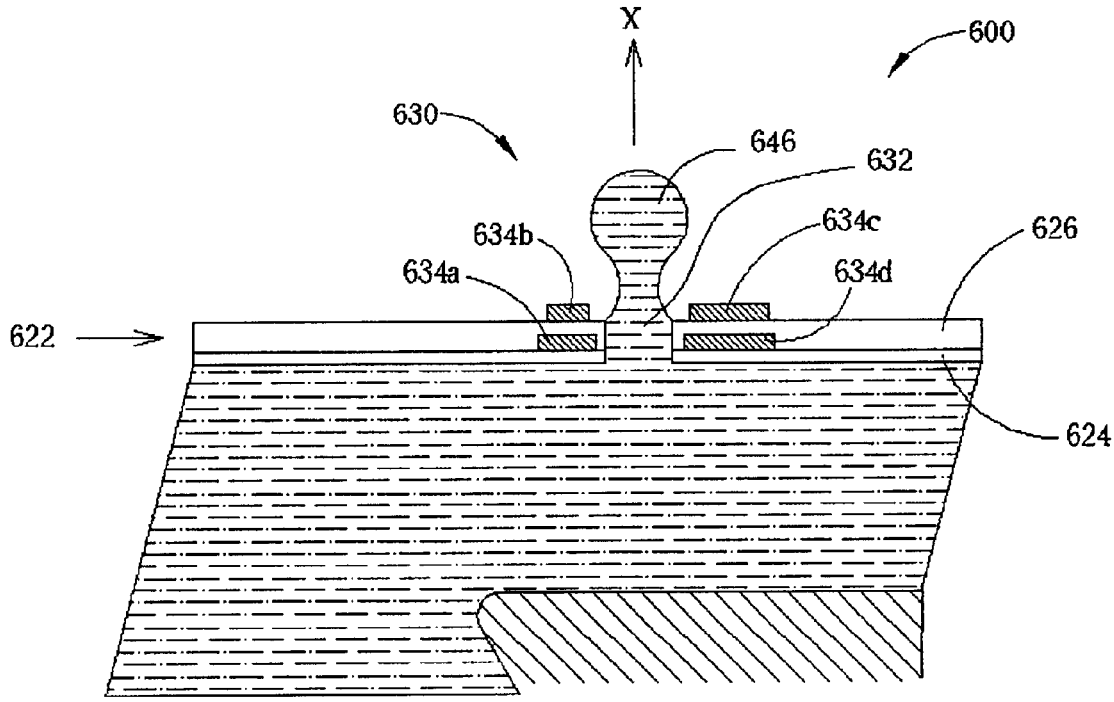
FIG. 16 is a section view of a nozzle of a jet according to a sixth embodiment of the present invention.

Please refer to FIG. 16, which is a sectional view of a nozzle 630 of a jet 600 according to a sixth embodiment of the present invention. The jet 600 is similar to the jet 500. The jet 600 comprises an orifice layer 622. The orifice layer 622 further comprises two structure layers 624 and 626. Each nozzle 630 of the jet 600 comprises heaters 634*a,* 634*b,* 634*c* and 634*d* disposed on the two structure layers 624 and 626. In comparison with the jet 500, the heaters 634*a* and 634*b* and the heaters 634*c* and 634*d* of the jet 600 are disposed along the same direction, respectively. As shown in FIG. 16, a droplet 646 formed by the nozzle 630 is ejected along a direction X from the orifice 632. The heaters 634*a* and 634*b* linearly disposed on the structure layers 624 and 626 along the direction X. The heaters 636*d* and 636*c* are also linearly disposed on the structure layers 624 and 626 along the direction X. As a result, more nozzles 630 of the jet 600 can be disposed in the same unit area than those of the jet 500.

Figure 17:
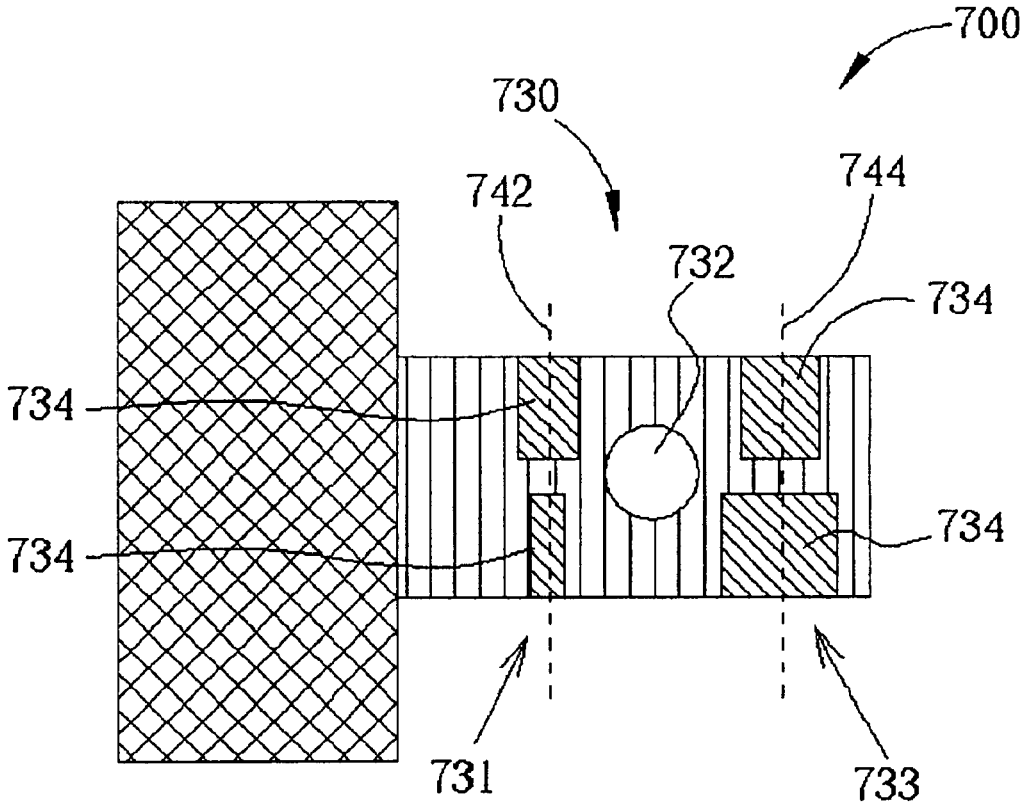
FIG. 17 is a top view of a nozzle of a jet according to a seventh embodiment of the present invention.
Figure 18:
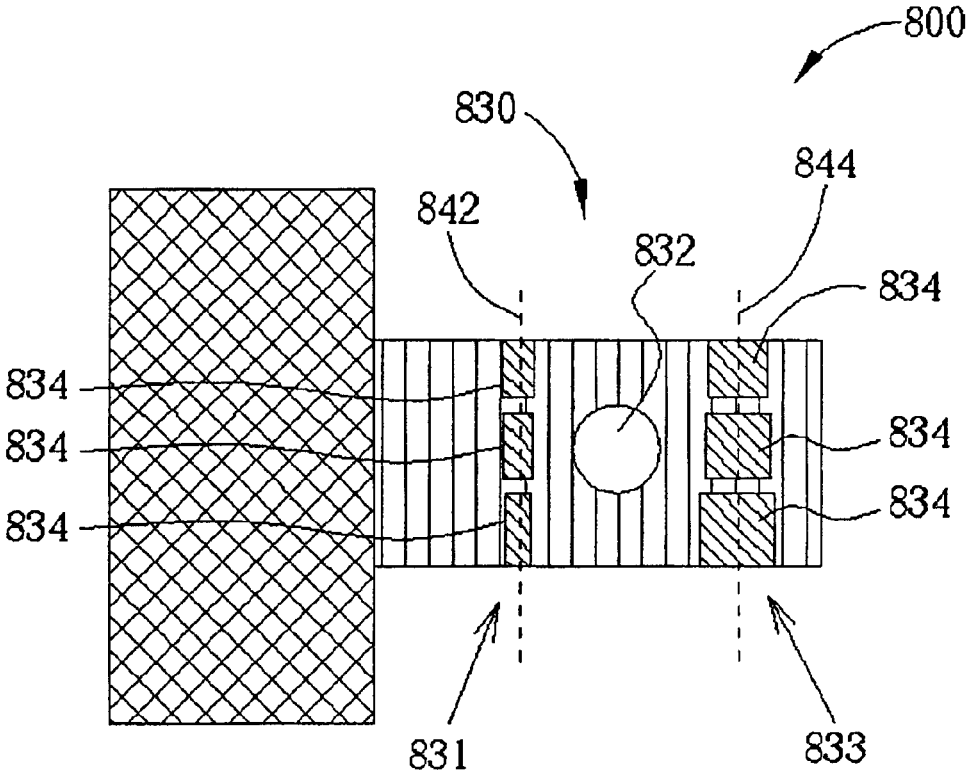
FIG. 18 is a top view of a nozzle of a jet according to an eighth embodiment of the present invention.

In the embodiments mentioned above, the bubble generators are disposed in parallel on the first side and the second side of the orifice. However, the present invention is not limited to such embodiments. Please refer to FIG. 17 and FIG. 18. FIG. 17 is a top view of a nozzle 730 of a jet 700 according to a seventh embodiment of the present invention. FIG. 18 is a top view of a nozzle 830 of a jet 800 according to an eighth embodiment of the present invention. As shown in FIG. 17, each nozzle 730 of the jet 700 comprises a bubble generator 732 on a first side 731 of the orifice 732 disposed on a first line 742. The nozzle 730 further comprises a bubble generator 734 on a second side 733 of the orifice 732 disposed on a second line 744, wherein the first line 742 and the second line 744 are parallel. As shown in FIG. 18, each nozzle 830 of the jet 800 comprises a bubble generator 832 on a first side 831 of the orifice 832 disposed on a first line 842. The nozzle 830 further comprises a bubble generator 834 on a second side 833 of the orifice 832 disposed on a second line 844, wherein the first line 842 and the second line 844 are parallel. Thus, the jet 800 comprises more bubble generators 834 so that there is a greater variability in the number of potential driving methods than found in the other embodiments. This, in turn, means that droplets of greater variety of sizes are possible from the nozzle 830.

Figure 19:
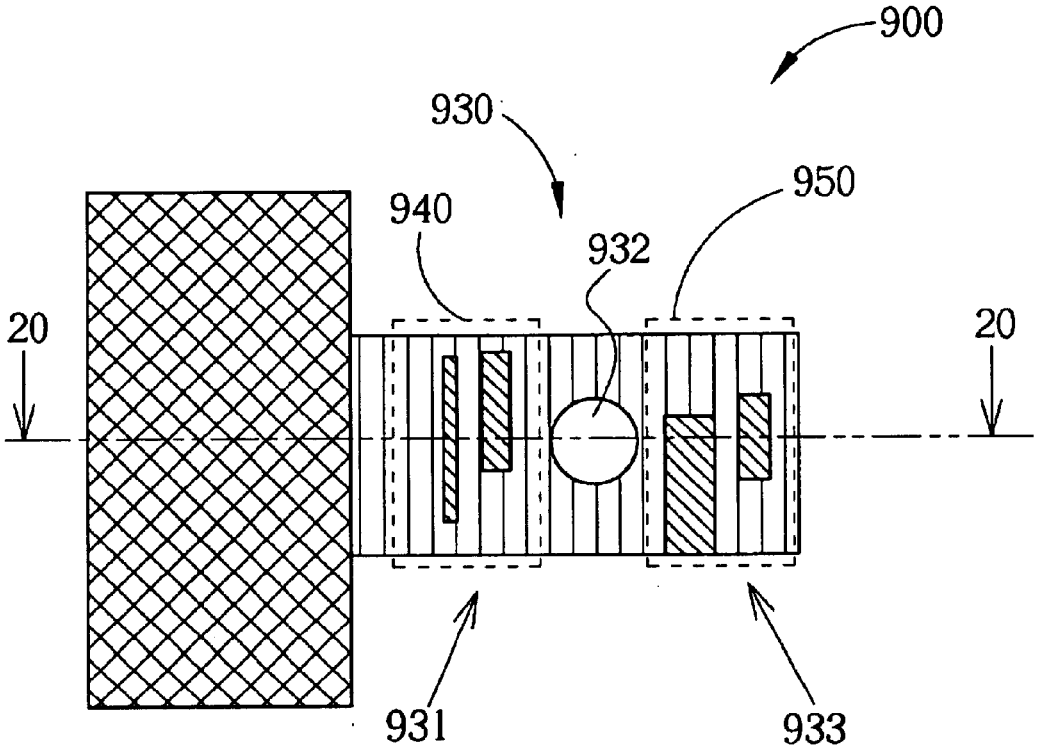
FIG. 19 is a top view of a nozzle of a jet according to a ninth embodiment of the present invention.
Figure 20:
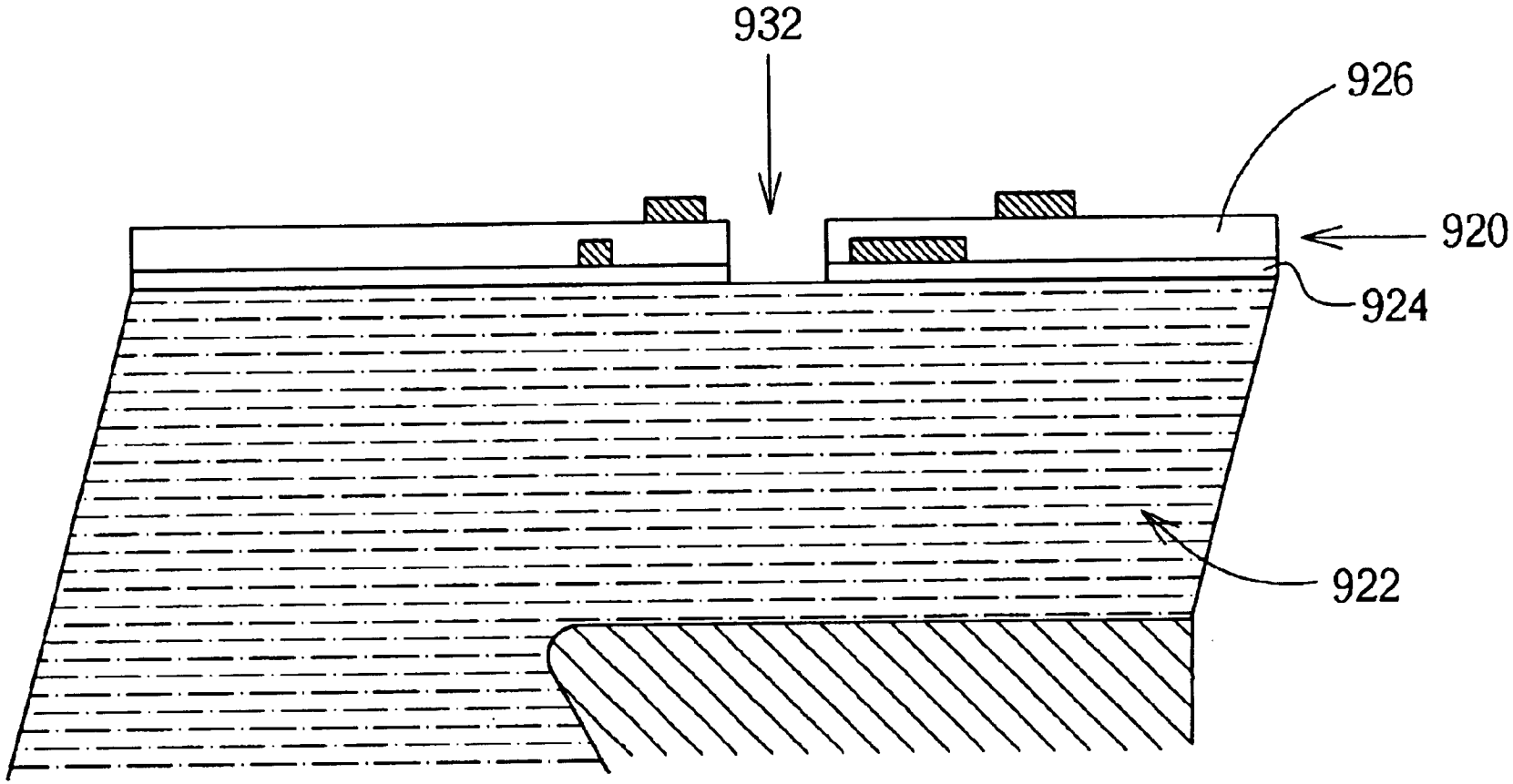
FIG. 20 is a section view along line 20—20 of the nozzle shown in FIG. 19.

The bubble generators can be disposed on other ways, such as a mixed mode of horizontal and vertical directions. Please refer to FIG. 19 and FIG. 20. FIG. 19 is a top view of a nozzle 930 of a jet 900 according to a ninth embodiment of the present invention. FIG. 20 is a sectional view along line 20—20 of the nozzle 930 shown in FIG. 19. The jet 900 comprises an orifice layer 920 comprising two structure layers 924 and 926. A first group 940 of bubble generators is disposed on a first side 931 of the nozzle 930 and a second group 950 of bubble generators is disposed on a second side 933 of the nozzle 930. Both the first and second group 940 and 950 comprise a plurality of bubble generators, and each of the bubble generators is disposed on the two structure layers 924 and 926. Each bubble generator is a heater, and is independently controlled to generate bubbles in its corresponding chamber 922. Thus, bubbles are generated by controlling bubble generators on the both sides of the nozzles 930 to squeeze fluid inside the chambers 922 out of the orifice 932 so that droplets of different sizes are ejected.

In contrast to the prior art jet, the jet according to the present invention comprises a plurality of nozzles comprising at least three bubble generators electrically connected to a driving circuit. A plurality of bubble generators are divided into two groups disposed on the first side and the second side of the orifice, which generate a first bubble and a second bubble in a corresponding chamber. The first bubble functions as a virtual valve to protect adjacent chambers from cross-talk. Both the first and second sides comprise at least one bubble generator, and at least one side comprises at least two bubble generators. The driving circuit drives the plurality of bubble generators selectively to generate droplets of different sizes. In addition, since the nozzles generate the first bubble and second bubble in order, a tail of the droplet is suddenly cut as the second bubble squeezes fluid out of the orifice. Therefore, no satellite droplets are formed in the present invention. In addition to the purpose of improving the variability of colors and printing speed of ink jet printers, the present invention can also be used to improve fuel combustion efficiency in engines.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A jet in flow communications with a reservoir comprising:

a substrate having a manifold for receiving fluid from the reservoir;

an orifice layer disposed above the substrate so that a plurality of chambers are formed between the orifice layer and the substrate; and a plurality of nozzles that are disposed on the orifice layer and correspond to the plurality of chambers for ejecting the fluid in the chambers so as to form a plurality of droplets, each of the nozzles comprising:

an orifice formed on the orifice layer; and at least three distinct heaters electrically connected to a driving circuit and disposed at a first side of the orifice and a second side of the orifice, at least two of the heaters disposed at one of either the first side or the second side, and at least one of the heaters disposed at the other of the first side and the second side, the driving circuit driving the heater(s) disposed at the first side to heat fluid to generate a first bubble in a corresponding chamber and driving the heater(s) disposed at the second side to heat fluid to generate a second bubble in the corresponding chamber;

wherein each heater disposed at either the first side or the second side is connected in series to one of the heater(s) disposed at the other side, wherein the driving circuit is capable of independently driving or simultaneously driving each heater disposed on the same side of the orifice along with the corresponding heaters disposed on the other side of the orifice that are serially connected to the driven heaters;

wherein the driving circuit drives the heaters selectively so that each of the nozzles is capable of ejecting droplets of different sizes.

2. The jet of claim 1 wherein at least two heaters are disposed at the first side, and each of the nozzles comprises a leading wire for connecting one of the heater(s) disposed at the second side with the heaters disposed at the first side, and the driving circuit applies a voltage on at least one of the heaters disposed at the first side to generate the first bubble and the second bubble simultaneously.

3. The jet of claim 1 wherein at least two heaters are disposed at the second side, and each of the nozzles comprises a leading wire for connecting one of the heater(s) disposed at the first side with the heaters disposed at the second side, and the driving circuit applies a voltage on at least one of the heaters disposed at the second side to generate the first bubble and the second bubble simultaneously.

4. A jet in flow communication with a reservoir comprising:

an orifice disposed above the reservoir;

a first bubble generator group disposed at a first side of the orifice for generating a first bubble in the reservoir; and a second bubble generator group disposed at a second side of the orifice for generating a second bubble in the reservoir, the first bubble and the second bubble squeezing fluid between the first bubble and the second bubble out of the orifice to form a droplet;

wherein the first bubble generator group and the second bubble generator group together comprise at least three distinct bubble generators, the first bubble generator group or the second bubble generator group comprises at least two independently drivable bubble generators for generating the first bubble or the second bubble, and the other of the first bubble generator group or the second bubble generator group comprises at least one distinct bubble generator.

5. The jet of claim 4 wherein each of the bubble generators is a heater.

6. The jet of claim 4 wherein an interval between the orifice and one of the two bubble generators is different from an interval between the orifice and the other one of the two bubble generators.

7. The jet of claim 4 wherein a resistance value of each of the bubble generator(s) in the first bubble generator group is different from a resistance value of each of the bubble generator(s) in the second bubble generator group.

8. The jet of claim 4 wherein each of the bubble generators in the first bubble generator group and the second bubble generator group has a unique resistance value.

9. The jet of claim 4 further comprising a manifold for receiving fluid from the reservoir, wherein the first bubble is used as a virtual valve to restrict fluid to avoid flowing to the manifold.

10. The jet of claim 4 further comprising a driving circuit electrically connected to the bubble generators and wherein each of the bubble generators is a heater, the driving circuit drives the heater(s) disposed at the first side to heat fluid so as to generate the first bubble, and the driving circuit drives the heater(s) disposed at the second side to heat fluid so as to generate the second bubble.

11. The jet of claim 10 wherein each heater disposed at either the first side or the second side is connected in series to one of the heater(s) disposed at the other side, wherein the driving circuit is capable of independently driving or simultaneously driving each heater disposed on the same side of the orifice along with the corresponding heaters disposed on the other side of the orifice that are serially connected to the driven heaters.

12. The jet of claim 11 wherein at least two heaters are disposed at the first side, the jet further comprising a leading wire for connecting one of the heater(s) disposed at the second side with the heaters disposed at the first side, and a driving circuit applies a voltage on at least one of the heaters disposed at the first side to generate the first bubble and the second bubble simultaneously.

13. The jet of claim 11 wherein at least two heaters are disposed at the second side, the jet further comprising a leading wire for connecting one of the heater(s) disposed at the first side with the heaters disposed at the second side, and a driving circuit applies a voltage on at least one of the heaters disposed at the second side to generate the first bubble and the second bubble simultaneously.

14. The jet of claim 10 wherein two heaters are disposed on the first side and one heater is disposed on the second side, each of the heaters disposed on the first side is connected in series to the heater disposed on the second side, the driving circuit is capable of simultaneously driving the two heaters disposed on the first side along with the heater disposed on the second side to generate the first and second bubbles, and the driving circuit is capable of driving either one of the heaters disposed on the first side along with the heater disposed on the second side to generate the first and second bubbles.

15. The jet of claim 10 wherein there is at least one heater disposed at the first side connected in parallel to one of the heater(s) disposed at the second side, wherein a resistance of the heater disposed at the first side is less than a resistance of the heater disposed at the second side.

16. The jet of claim 10 wherein the orifice is formed in an orifice layer comprising at least two structure layers arranged in parallel, and there is at least one heater disposed on each of the structure layers.

17. The jet of claim 16 wherein the droplet is ejected from the orifice along an ejection direction, and at least two of the heaters are disposed on the two structure layers linearly along the ejection direction.

18. The jet of claim 4 wherein the droplet is ejected from the orifice along an ejection direction, and the bubble generators are disposed in parallel at the first side and the second side.

19. The jet of claim 4 wherein the bubble generator(s) disposed at the first side are arranged along a first straight line, the bubble generator(s) disposed at the second side are arranged along a second straight line, and the first straight line is parallel to the second straight line.

20. A jet in flow communication with a reservoir comprising:

an orifice disposed above the reservoir;

a first bubble generator group disposed at a first side of the orifice for generating a first bubble in the reservoir; and a second bubble generator group disposed at a second side of the orifice for generating a second bubble in the reservoir, the first bubble and the second bubble squeezing fluid between the first bubble and the second bubble out of the orifice to form a droplet;

wherein a number of bubble generators in the first bubble generator group is different from a number of bubble generators in the second bubble generator group.

21. The jet of claim 20 wherein the first bubble generator group and the second bubble generator group together comprise at least three distinct bubble generators, the first bubble generator group or the second bubble generator group comprises at least two independently drivable bubble generators for generating the first bubble or the second bubble, and the other of the first bubble generator group or the second bubble generator group comprises at least one distinct bubble generator.

22. The jet of claim 21 wherein the first bubble generator group comprises two bubble generators and the second bubble generator group comprises one bubble generator.

23. The jet of claim 21 wherein the first bubble generator group comprises one bubble generator and the second bubble generator group comprises two bubble generators.

24. The jet of claim 20 wherein a resistance value of each bubble generator in the first bubble generator group is different from a resistance value of each bubble generator in the second bubble generator group.

25. The jet of claim 20 wherein each bubble generator in the first bubble generator group and the second bubble generator group has a unique resistance value.

26. The jet of claim 20 further comprising a driving circuit electrically connected to the bubble generators and wherein each bubble generator is a heater, the driving circuit drives the heater(s) disposed at the first side to heat fluid so as to generate the first bubble, and the driving circuit drives the heater(s) disposed at the second side to heat fluid so as to generate the second bubble.

27. The jet of claim 26 wherein each heater disposed at either the first side or the second side is connected in series to one of the heater(s) disposed at the other side, wherein the driving circuit is capable of independently driving or simultaneously driving each heater disposed on the same side of the orifice along with the corresponding heaters disposed on the other side of the orifice that are serially connected to the driven heaters.

28. The jet of claim 26 wherein two heaters are disposed on the first side and one heater is disposed on the second side, each of the heaters disposed on the first side is connected in series to the heater disposed on the second side, the driving circuit is capable of simultaneously driving the two heaters disposed on the first side along with the heater disposed on the second side to generate the first and second bubbles, and the driving circuit is capable of driving either one of the heaters disposed on the first side along with the heater disposed on the second side to generate the first and second bubbles.

29. A jet in flow communications with a reservoir comprising:

a substrate having a manifold for receiving fluid from the reservoir;

an orifice layer disposed above the substrate so that a plurality of chambers are formed between the orifice layer and the substrate; and a plurality of nozzles that are disposed on the orifice layer and correspond to the plurality of chambers for ejecting the fluid in the chambers so as to form a plurality of droplets, each of the nozzles comprising:

an orifice formed on the orifice layer; and two heaters electrically connected to a driving circuit and disposed at a first side of the orifice and one heater electrically connected to the driving circuit and disposed at a second side of the orifice, the driving circuit driving the two heaters disposed at the first side to heat fluid to generate a first bubble in a corresponding chamber and driving the heater disposed at the second side to heat fluid to generate a second bubble in the corresponding chamber;

wherein each of the heaters disposed on the first side is connected in series to the heater disposed on the second side, the driving circuit is capable of simultaneously driving the two heaters disposed on the first side along with the heater disposed on the second side to generate the first and second bubbles, and the driving circuit is capable of driving either one of the heaters disposed on the first side along with the heater disposed on the second side to generate the first and second bubbles;

wherein the driving circuit drives the heaters selectively so that each of the nozzles is capable of ejecting droplets of different sizes.

* * * * *